US011612794B2

(12) United States Patent
Givens

(10) Patent No.: US 11,612,794 B2
(45) Date of Patent: Mar. 28, 2023

(54) BREAKAWAY BASKETBALL RIM

(71) Applicant: Mega Slam Hoops, LLC, San Antonio, TX (US)

(72) Inventor: Jon Casey Givens, Katy, TX (US)

(73) Assignee: MEGA SLAM HOOPS, LLC, San Antonio, TX (US)

( * ) Notice: Subject to any disclaimer, the term of this patent is extended or adjusted under 35 U.S.C. 154(b) by 0 days.

(21) Appl. No.: 15/410,062

(22) Filed: Jan. 19, 2017

(65) Prior Publication Data

US 2018/0200595 A1 Jul. 19, 2018

(51) Int. Cl.
*A63B 63/08* (2006.01)

(52) U.S. Cl.
CPC ..... *A63B 63/083* (2013.01); *A63B 2063/086* (2013.01)

(58) Field of Classification Search
CPC .. A63B 63/08; A63B 63/083; A63B 2063/086
USPC ..... 473/486, 485, 481
See application file for complete search history.

(56) References Cited

U.S. PATENT DOCUMENTS 4,723,777 A * 2/1988 Jolly ..... A63B 63/083 473/486
5,106,084 A * 4/1992 Vaught ..... A63B 63/083 384/909
5,456,459 A * 10/1995 Gorman ..... A63B 63/083 473/486
5,586,759 A * 12/1996 Fitzsimmons ..... A63B 63/083 473/486
5,685,790 A * 11/1997 Vaught ..... A63B 63/083 473/486
5,816,955 A * 10/1998 Nordgran ..... A63B 63/083 473/486
6,080,071 A * 6/2000 Childers ..... A63B 63/083 473/486
6,186,911 B1 * 2/2001 Manthey ..... A63B 65/08 473/486
6,296,583 B1 * 10/2001 Tatar, Sr. ..... A63B 63/083 473/486
6,447,409 B1 * 9/2002 Squibb ..... A63B 63/083 473/486
7,175,551 B1 * 2/2007 Hamilton ..... A63B 63/083 473/486
9,415,285 B1 * 8/2016 Jolly ..... A63B 63/083
2006/0148598 A1 * 7/2006 Mahoney ..... A63B 63/083 473/481
2007/0167265 A1 * 7/2007 Connerley ..... A63B 63/083 473/485
2012/0244965 A1 * 9/2012 Connerley ..... A63B 63/083 473/486

* cited by examiner

*Primary Examiner* — Eugene L Kim
*Assistant Examiner* — Christopher Glenn
(74) *Attorney, Agent, or Firm* — Nolte Lackenbach Siegel

(57) ABSTRACT

A breakaway basketball rim, includes a base plate; a rim; and a collapsible assembly to which the base plate and the rim are affixed. The collapsible assembly further includes: a control subassembly affixed to the base plate and the rim; and a bearing subassembly horizontally disposed between the control subassembly and the rim.

5 Claims, 3 Drawing Sheets

BREAKAWAY BASKETBALL RIM

CROSS-REFERENCE TO RELATED APPLICATIONS

Not applicable.

STATEMENT REGARDING FEDERALLY SPONSORED RESEARCH OR DEVELOPMENT

Not applicable.

FIELD OF THE INVENTION

The presently disclosed invention pertains to basketball rims and, more particularly, to a collapsible, or breakaway, basketball rim.

BACKGROUND OF THE INVENTION

This section of this document introduces selected aspects of the art that may be related to various aspects of the present invention described and/or claimed below. It provides background information to facilitate a better understanding of the various aspects of the present invention. It is a discussion of "related" art. That such art is related in no way implies that it is also "prior" art. The related art may or may not be prior art. This discussion therefore is not an admission of prior art.

The rim mounted to the backboard is necessary equipment for the sport under the rules of basketball. It has become quite common for players to leap and "dunk" the basketball directly through the rim rather than shoot from the floor. Players occasionally grab the rim and hold onto it. This sometimes leads to structural failure in the rim, the backboard, or both. Such structural failures can require significant downtime in the game or practice as the rim and/or the backboard is replaced. Some cleanup is also occasionally warranted, especially when the backboard shatters and the pieces fall onto the court.

To address these issues, the art developed "collapsible rims", also sometimes known as "breakaway rims". These rims are designed so that the rim collapses downward when sufficient force is applied to the rim. This collapse is intentional, and is a controlled failure designed to otherwise protect the rim and the backboard from the type of uncontrolled failure described above. Once the force is dissipated or released, the rim snaps upward again back into place. Such a controlled collapse can protect the rim and backboard from damage or replacement in some circumstances.

However, such breakaway rims have not resolved the issues altogether. One unresolved issue is that the breakaway rims respond best to "dunks" performed head on to the rim. These dunks lend themselves to the singular downward force to which the rims are designed to react. However, many dunks come from of the rim, and even from the side. While the energy from such dunks that is directed downward can be dissipated by the breakaway rim, the lateral (or side-to-side) energy is not. The lateral energy can then damage the rim and/or the backboard despite the controlled collapse of the rim.

The present invention is directed to resolving, or at least reducing, one or all of the problems mentioned above.

SUMMARY OF THE INVENTION

In a first aspect, a breakaway basketball rim comprises: a base plate; a rim; and a collapsible assembly to which the base plate and the rim are affixed. The collapsible assembly includes: a control subassembly affixed to the base plate and the rim; and a bearing subassembly horizontally disposed between the control subassembly and the rim.

In a second aspect, a breakaway basketball rim comprises: a base plate; a rim; and a collapsible assembly to which the base plate and the rim are affixed. The collapsible assembly includes: means for controlling the position and the collapse of the rim; and means for bearing these lateral forces applied to the rim, the bearing means being disposed between the control subassembly and the rim.

In a third aspect, a breakaway basketball rim comprises: a base plate; a rim; and a collapsible assembly to which the base plate and the rim are affixed. The collapsible, assembly includes: a control subassembly affixed to the base plate and the rim: and a bearing subassembly horizontally disposed between the control subassembly and the rim. The control subassembly further includes: a cylindrical housing affixed to the base plate; and a spring subassembly disposed vertically within the cylindrical housing and affixed to the rim. The bearing subassembly further includes: a top plate affixed to the rim; a bottom plate; a plurality of bearings retained between the top plate and the bottom plate; and an anchor plate affixed to the cylindrical housing.

The above presents a simplified summary of the invention in order to provide a basic understanding of some aspects of the invention. This summary is not an exhaustive overview of the invention. It is not intended to identify key or critical, elements of the invention or to delineate the scope of the invention. Its sole purpose is to present some concepts in a simplified form as a prelude to the more detailed description that is discussed later.

BRIEF DESCRIPTION OF THE DRAWINGS

The invention may be understood by reference to the following description taken in conjunction with the accompanying drawings, in which like reference numerals identify like elements, and in which:

FIG. 3A is a side, plan view while FIG. 3B-3C are perspective views from two different perspectives.

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Figure 1:
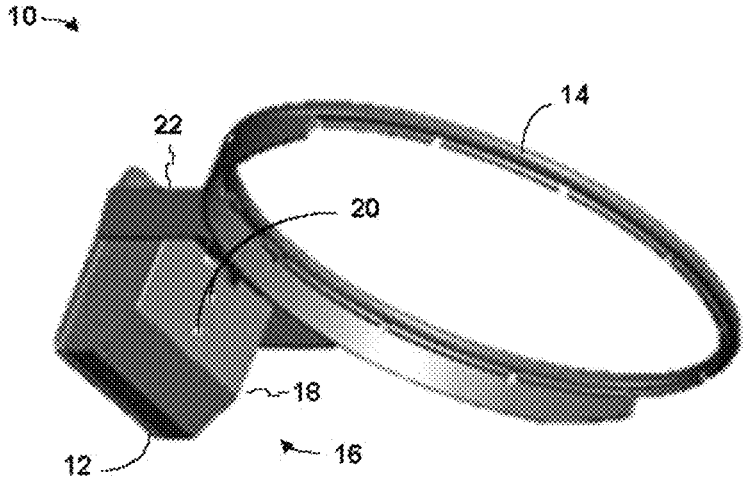
FIG. 1 depicts one particular embodiment of a breakaway basketball rim in accordance with the invention in a perspective, assembled view.

FIG. 1 illustrates one particular embodiment of a breakaway basketball rim 10 in accordance with the invention in an assembled view. This particular embodiment comprises a base plate 12, a rim 14, and a collapsible assembly 16. In the view in FIG. 1, much of the collapsible assembly 16 is obscured by a cover 18, which may be omitted in some embodiments. The cover 18 is affixed to other parts of the collapsible assembly 16 discussed below by fasteners 20. The base plate 12 and the rim 14 are fabricated of metal and are similarly otherwise of conventional design. Further discussion of the base plate 12 and rim 14 will therefore be omitted so as not to obscure the present invention. However, because of its utility to the illustrated embodiment, note that the rim 14 includes a mounting plate 22.

Figure 2:
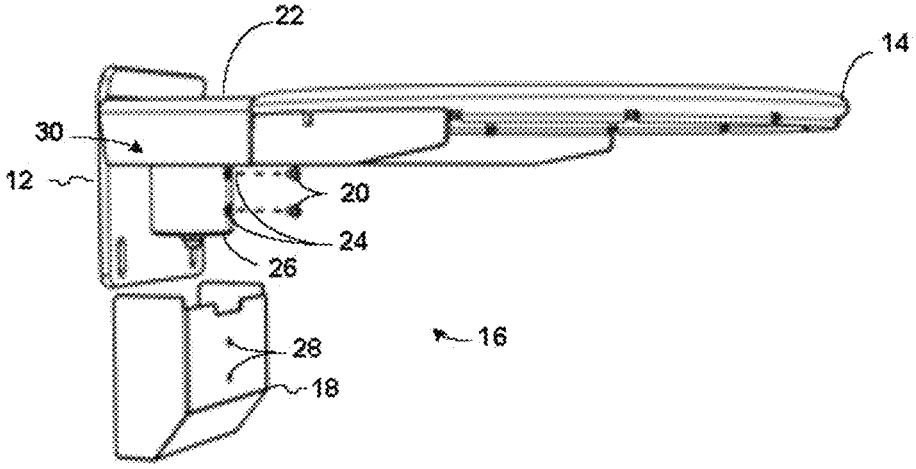
FIG. 2 shows the breakaway basketball rim of FIG. 1 with the cover of the collapsible assembly disassembled and from a second perspective.

FIG. 2 illustrates the breakaway basketball rim 10 with the cover 18 disassembled by removal of the fasteners 20. Assembly is effected by inserting the fasteners 20 into the blind bores 24 in a cylindrical housing 26 through the holes 28 in the cover 18 with the cover 18 in place. The fasteners 20 are bolts and so the blind bores 24 are threaded. Most embodiments employing bolts will also use washers (not shown) in a manner known to those in the art.

The cylindrical housing 26 comprises a portion of the collapsible assembly 16 and is affixed to the base plate 12. The cylindrical housing 26 is fabricated of metal, as is the base plate 12. The cylindrical housing 26 is affixed in this particular embodiment by a weld, although other techniques may be used in alternative embodiments. This affixation between the cylindrical housing 26 and the base plate 12 provides the affixation between the collapsible assembly 16 generally to the base plate 12. Other embodiments may affix the collapsible assembly 16 to the base plate 12 in other ways, however.

Figure 3A:
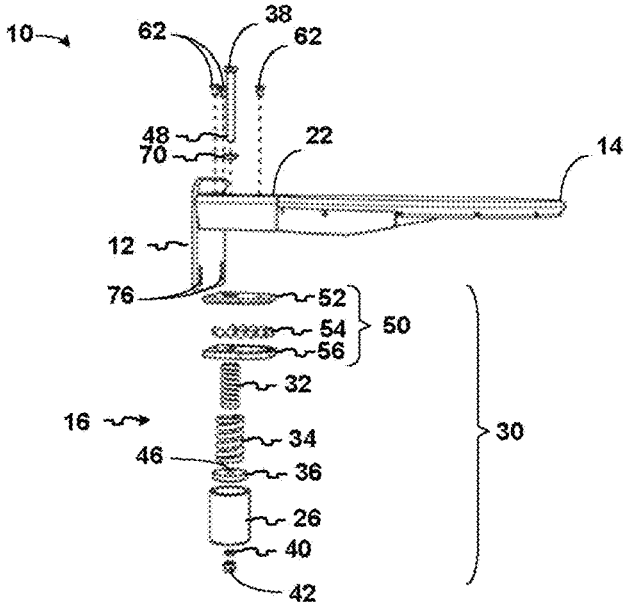
FIG. 3A-3C illustrate the breakaway basketball rim of FIG. 1-FIG. 2 in exploded views less the cover to better reveal a control subassembly.
Figure 3B:
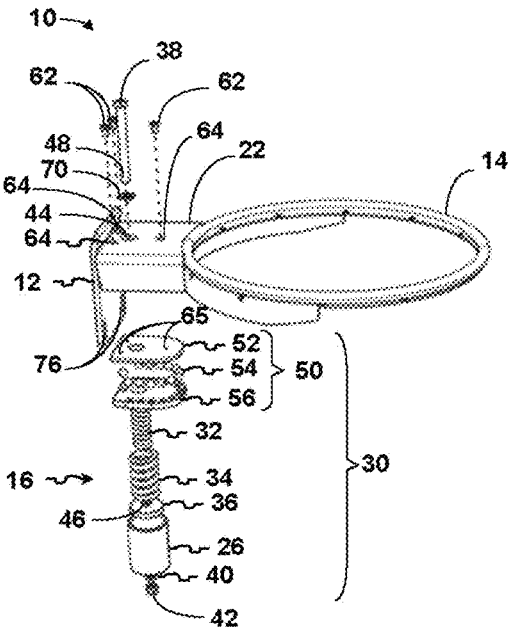
Figure 3C:
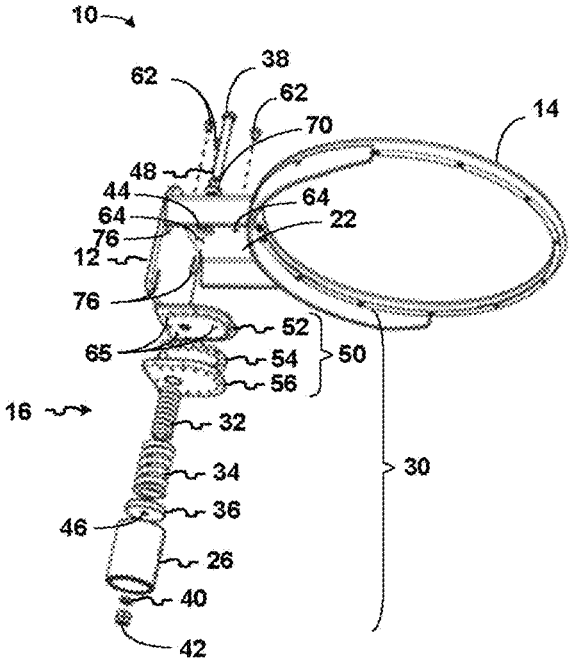

FIG. 3A-3C illustrate selected portions of the breakaway basketball rim 10 of FIG. 1-FIG. 2 in exploded views less the cover 18 to better reveal a control subassembly 30. The control subassembly 30 is disposed vertically within the cylindrical housing 26 and is affixed to the rim 14. The control subassembly 30 includes an inner spring 32, an outer spring 34, a back plate 36, a pin 38, a washer 40, and a cap 42. As indicated by the use of the inner spring 32 and the outer spring 34, the control subassembly 30 is a spring subassembly in this particular embodiment.

Referring now to FIG. 3A to FIG. 3C, collectively, the inner spring 32 nests inside the outer spring 34. The pin 38 is inserted through the opening 44 in the mounting plate 22 as best shown in FIG. 3B-FIG. 3C, through the nested inner spring 32 and outer spring 34, and through the opening 46 in the back plate 36. The end 48 of the pin 38 is threaded. Once the pin 38 is inserted as described above, the inner spring 32 and outer spring 34 are compressed to expose the end 48 of the pin 38 through the opening 46 in the back plate 36. The washer 40 is then positioned over the end 48 and the cap 42 threaded onto the end 48 to complete the subassembly while the springs 32, 34 are under compression.

Those in the art having the benefit of this disclosure will appreciate that the position of the rim 14 may be maintained and its collapse controlled responsive to downward energy as described above using mechanisms other than springs. For example, some embodiments may use compressed air contained in a defined volume. Thus, the control subassembly 32 is, by way of example and illustration, but one means for controlling the position and collapse of the rim. Embodiments alternative to that illustrated herein may use alternative means of equivalent structure that perform this function. Still other alternative embodiments may employ still other mechanisms entirely.

FIG. 3A-FIG. 3C also reveal a bearing subassembly 50. The bearing subassembly 50 includes a top bearing plate 52, a plurality of bearings 54, and a bottom bearing plate 56. The top bearing plate 42 is affixed to the underside of the mounting plate 22 using a plurality of fasteners 62 through a plurality of holes 64 therein and the holes 65 in the top bearing plate 42. The bottom bearing plate 56 is affixed to the cylindrical housing 26 in a manner not shown. In one particular embodiment, the bottom bearing plate 56 is fabricated from metal and then welded directly to the top of the cylindrical housing 26. In alternative embodiments, the cylindrical housing 26 may be fitted with a flange (not shown) and the bottom bearing plate 56 fastened to the flange. Other alternatives may become apparent to those skilled in the art having the benefit of this disclosure.

The top plate 52 and bottom plate 56 both have indentations 60 (only one indicated) in which the bearings 54 rest. More particularly, each indentation 60 in the top plate 52 opposes an indentation 60 in the bottom plate 56 when assembled. A respective bearing 54 rests in the pocket created by the opposing indentations 60. The design and construction disclosed herein permit relative movement between the top plate 52 and the bottom plate 56, thereby causing the bearings 54 to help dissipate or mitigate downward and lateral forces imparted to the rim 14.

Still referring to FIG. 3A-FIG. 3C, the bearing subassembly 50 is maintained in its assembled state through its assembly and facilitates the spring pressure of the inner spring 32 and outer spring 34 operating against the back plate 36 when assembled into the control subassembly 30 as described above. Each of the top plate 52, bottom plate 56, and anchor plate includes an opening 46. When the pin 38 is inserted through the opening 44 in the mounting plate 22 and the control subassembly 30 as described above, it is also inserted through the openings 46 in the top plate 52, bottom plate 56, and anchor plate. The bearing subassembly 50 is horizontally disposed between the control subassembly 30 and the rim 14. The spring pressure, in conjunction with the pockets defined by the opposing indentations 60 in the top plate 52 and the bottom plate 56, retain the bearings 54 between the top plate 52 and the bottom plate 56.

Those in the art having the benefit of this disclosure may appreciate bearing mechanisms alternative to that shown that will bear lateral forces applied to the rim 14. Thus, the bearing mechanism shown is, by way and illustration, but one means for bearing these lateral forces. Embodiments alternative that shown may employ alternative mechanisms having equivalent structure that perform the function of bearing lateral forces applied to the rim 14.

As alluded to above, the collapsible assembly 16 is assembled by affixing the top plate 52 to the underside of the mounting plate 22 and the bottom plate 56 to the cylindrical housing 26. The pin 38 is then inserted through the washer 70, the opening 64 in the mounting plate 22; the openings 46 of the top plate 52, and the bottom plate 56; through the inner spring 32 and the outer spring 34; and through the opening 46 in the back plate 36. The cap 42 is threaded onto the end of the pin 38. The inner spring 32 and the outer spring 34 are thereby compressed between the mounting plate 22 and the back plate 36.

As used herein, terms of relative location and orientation like "vertical", "horizontal", "top,","bottom" "lateral", and "underside" are defined relative to the orientation of the rim 14 in its normal, intended use. The opening of the rim 14 in that orientation will substantially parallel that of the court or ground, the circumference radiating outwardly from a normal to the court.

Figure 4:
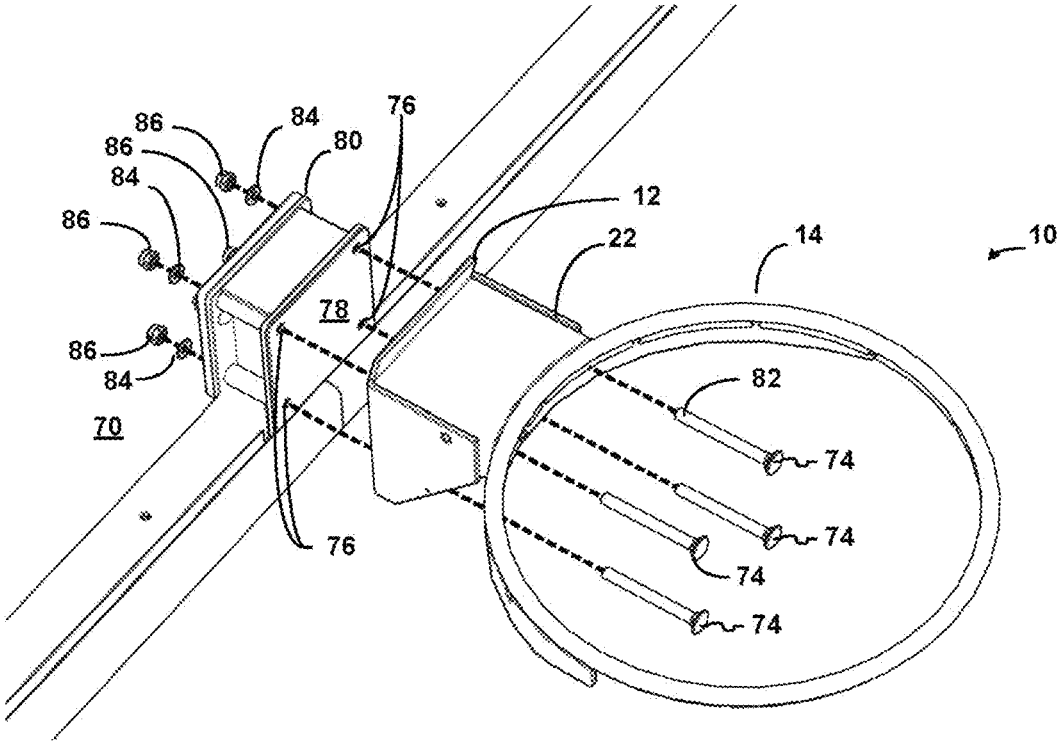
FIG. 4 depicts mounting of the breakaway basketball rim of FIG. 1-FIG. 3C to a backboard in one particular embodiment.

In use, the breakaway basketball rim 10 is mounted to the backboard 72 via the base plate 12 in conventional fashion as shown in FIG. 4. More particularly, a plurality of fasteners 74 are inserted through holes 76, shown in FIG. 3A-FIG. 3C, and co-aligned holes 76 in a front mounting plate 78, the backboard 72, and a back mounting plate 80. The fasteners 74 are threaded at least on their distal ends 82 (only one indicated). They are secured by washers 84 and caps 86 threaded onto the distal ends 82 on the backside of the backboard 72 when threaded through the holes 76.

Downward and lateral forces applied to the rim 14 are absorbed by the control subassembly 30 which then returns the rim 14 to its original position once the downward forces are released. Lateral forces applied to the rim 14 are mitigated by the bearing subassembly 50 to help prevent deformation of and other damage to the rim 14 as well as the backboard. In this manner, downward and lateral forces as mitigated rather than being transferred directly to the backboard 72.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A breakaway basketball rim, comprising:

a base plate defining a plurality of holes, the base plate configured to directly mount to a backboard via a plurality of first fasteners inserted through the holes;

a rim including a mounting plate extending from the base plate, the mounting plate further extending from the backboard when the base plate is mounted to the backboard; and a collapsible assembly to which the base plate and the rim are affixed, the collapsible assembly dissipating both downward and lateral forces applied to the rim by allowing for vertical deflection of the rim relative to the baseplate in response to downward forces applied to the rim and by allowing for lateral deflection of the rim relative to the base plate in response to lateral forces applied to the rim, and further comprising: a control subassembly affixed to the base plate and affixed to the mounting plate of the rim by a second fastener extending through an opening defined by the mounting plate, the control subassembly comprising a spring subassembly through which the second fastener extends; wherein the spring subassembly includes an inner spring nested inside an outer spring, and the control subassembly is oriented to direct spring pressure of the inner spring and outer spring vertically with respect to the rim the spring subassembly and the control subassembly dissipating vertical forces applied to the rim by allowing vertical deflection of the rim in response to downward forces applied to the rim;

a bearing subassembly horizontally disposed between the control subassembly and the rim to dissipate lateral forces applied to the rim by allowing lateral deflection of the rim in response to lateral forces applied to the rim, wherein the bearing subassembly includes:

a bearing subassembly top plate contacting and affixed to the mounting plate of the rim and defining a bearing subassembly top plate opening;

a bearing subassembly bottom plate defining a bearing subassembly bottom plate opening; and a plurality of bearings retained between the bearing subassembly top plate and the bearing subassembly bottom plate wherein the second fastener extends through the bearing subassembly top plate opening and the bearing subassembly bottom plate opening and is surrounded by the plurality of bearings;

and wherein the control subassembly is oriented to direct spring pressure of the inner spring and outer spring vertically against the bearing subassembly bottom plate.

2. The breakaway basketball rim of claim 1, wherein the collapsible assembly includes a cover for enclosing the bearing and control subassemblies.

3. The breakaway basketball rim of claim 1, wherein the bearing subassembly is pressed between the control subassembly and the rim.

4. The breakaway basketball rim of claim 1, wherein the control subassembly includes a cylindrical housing affixed to the base plate by a weld.

5. The breakaway basketball rim of claim 1, wherein the control subassembly includes:

a cylindrical housing affixed to the base plate, wherein the spring subassembly is disposed vertically within the cylindrical housing and affixed to the rim.

* * * * *